US011365738B2

(12) United States Patent
Ulliman et al.

(10) Patent No.: US 11,365,738 B2
(45) Date of Patent: Jun. 21, 2022

(54) REVERSING GRINDER PUMP

(71) Applicant: ZOELLER PUMP COMPANY, LLC, Louisville, KY (US)

(72) Inventors: Andrew Ulliman, Louisville, KY (US); Charles P. Carroll, Louisville, KY (US); Jerry Banta, Louisville, KY (US); Tanner Gibson, Louisville, KY (US)

(73) Assignee: Zoeller Pump Company, LLC, Louisville, KY (US)

( * ) Notice: Subject to any disclaimer, the term of this patent is extended or adjusted under 35 U.S.C. 154(b) by 145 days.

(21) Appl. No.: 16/837,765

(22) Filed: Apr. 1, 2020

(65) Prior Publication Data

US 2021/0148365 A1 May 20, 2021

Related U.S. Application Data

(60) Provisional application No. 62/831,430, filed on Apr. 9, 2019.

(51) Int. Cl.

| | |
|---|---|
| ***F04D 7/04*** | (2006.01) |
| ***B02C 18/18*** | (2006.01) |
| ***F04D 29/22*** | (2006.01) |
| ***B02C 18/00*** | (2006.01) |

(52) U.S. Cl.

CPC ..... *F04D 7/045* (2013.01); *B02C 18/182* (2013.01); *F04D 29/2288* (2013.01); *B02C 18/0092* (2013.01)

(58) Field of Classification Search

CPC ..... F04D 7/045; F04D 29/2288; F04D 2/00; B02C 18/0092; B02C 18/182

USPC ..... 241/83, 85

See application file for complete search history.

(56) References Cited

U.S. PATENT DOCUMENTS

| | | | |
|---|---|---|---|
| 3,155,046 | A | 11/1964 | Vaughan |
| 3,650,481 | A | 3/1972 | Conery et al. |
| 4,911,368 | A | 3/1990 | Nishimori |
| 5,030,147 | A | 7/1991 | Binversie et al. |
| 5,256,032 | A | 10/1993 | Dorsch |

(Continued)

FOREIGN PATENT DOCUMENTS

| | | | |
|---|---|---|---|
| CN | 202273899 | U | 6/2012 |

OTHER PUBLICATIONS

"ProVore® PRG-Series" flyer by LibertyPumps® (2015).

(Continued)

*Primary Examiner* — Debra M Sullivan
*Assistant Examiner* — Matthew Stephens
(74) *Attorney, Agent, or Firm* — Scott R. Cox; Jeffery P. Langer; Jessica C. Ronald

(57) ABSTRACT

A reversible grinder pump with cutter plate and cutter blade, wherein the cutter plate is attached to an inlet of the reversible grinder pump and is located adjacent to the cutter blade, wherein the cutter plate includes pairs of angled openings, wherein each of the pair of angled openings extends through the cutter plate and has a shape which is a mirror image of the other angled opening of the pair of angled openings, when viewed from above a surface of the cutter plate. The cutter blade of the reversible grinder pump contains a pair of triangular cross section, prism-shaped cutting edges, which are congruent to each other and reflective, extending in opposite directions from each other.

17 Claims, 8 Drawing Sheets

(56) References Cited

U.S. PATENT DOCUMENTS

| | | | | |
|---|---|---|---|---|
| 6,190,121 | B1 | 2/2001 | Hayward et al. | |
| 6,676,382 | B2 | 1/2004 | Leighton et al. | |
| 7,159,806 | B1 * | 1/2007 | Ritsema | B02C 18/0092 241/258 |
| 7,237,736 | B1 | 7/2007 | Martin | |
| 7,520,454 | B2 | 4/2009 | Zelder et al. | |
| 7,584,916 | B2 | 9/2009 | Shaw | |
| 7,967,553 | B2 | 6/2011 | Wagner | |
| D653,264 | S | 1/2012 | Schmidt et al. | |
| 8,105,017 | B2 | 1/2012 | Dorsch et al. | |
| 8,267,643 | B2 | 9/2012 | Wagner et al. | |
| 8,562,287 | B2 | 10/2013 | Schmidt et al. | |
| 8,657,564 | B2 | 2/2014 | Cuppetelli | |
| 8,784,038 | B2 | 7/2014 | Ciotola | |
| 9,004,381 | B2 | 4/2015 | Schmidt et al. | |
| 9,261,095 | B2 | 2/2016 | Garvin et al. | |
| 9,352,327 | B2 * | 5/2016 | Schmidt | B02C 18/0092 241/258 |
| 9,475,059 | B2 | 10/2016 | Valien et al. | |
| 9,719,515 | B2 | 8/2017 | Pohler | |
| 10,054,136 | B2 | 8/2018 | Sowa et al. | |
| 11,253,866 | B2 | 2/2022 | Backe | |
| 2007/0164136 | A1 * | 7/2007 | Zelder | F04D 7/045 241/46.06 |
| 2012/0085688 | A1 * | 4/2012 | Schmidt | F04D 7/045 210/119 |
| 2014/0263788 | A1 * | 9/2014 | Vallen | B02C 18/062 241/220 |
| 2015/0115076 | A1 * | 4/2015 | Gormley | E03C 1/2665 241/30 |
| 2015/0377255 | A1 * | 12/2015 | Mitsch | F04D 29/426 415/121.1 |
| 2016/0363123 | A1 | 12/2016 | Davis | |
| 2018/0202453 | A1 * | 7/2018 | Pohler | F04D 29/2288 241/30 |
| 2020/0353475 | A1 * | 11/2020 | Brinkmann | B02C 18/0092 241/220 |

OTHER PUBLICATIONS

"LSG200-Series" flyer by LibertyPumps® (2004).

"Fractional HP Grinder Series the Shark Series" flyer by Zoeller® Pump Company (2016).

English Translation of Official Action issued by Taiwanese Patent Office dated Dec. 8, 2021 with respect to parallel Taiwan Patent Application No. 110112064.

English Translation of Chinese Evaluation Report of Utility Model Patent issued by Chinese Patent Office (CNIPA) dated Jan. 28, 2022 with respect to parallel Chinese Patent No. ZL2021206489638—cited only for references disclosed therein. Other non-cited references previously disclosed.

* cited by examiner

REVERSING GRINDER PUMP

CROSS REFERENCE TO RELATED APPLICATION

This application claims priority from provisional application Ser. No. 62/831,430, filed Apr. 9, 2019.

FIELD OF INVENTION

This invention relates to waste water systems which utilize pumps, particularly grinder pumps, and the design of a cutting system for those grinder pumps. More particularly, this invention relates to a reversible grinder pump containing an unique cutting system. This reversible grinder pump is useful with larger horsepower motors and particularly useful as a fractional horsepower reversible grinder pump because of its unique capability of cutting solids that are present within a basin or other container in which the reversible grinder pump is placed.

BACKGROUND OF INVENTION

This section is intended to introduce the reader to art that may be related to various aspects of the present invention, which are described and/or claimed below. This discussion is believed to be helpful in providing the reader with background information to facilitate a better understanding of the present invention. Accordingly, it should be understood that these statements are to be read in that light and not as an admission of prior art.

Sump pumps, grinder pumps, and other types of submersible pumps are placed in basins and other structural containers and are used for the treatment of and removal of waste water containing solids therefrom. For example, waste water disposal systems are often used in sewage systems for grinding and pumping waste water that contains solids.

Such systems include a grinder pump containing a cutter system for cutting or grinding solid or semi-solid matter present in the waste water. Such waste water disposal systems may be installed outdoors underground or indoors in a lower portion of a structure, such as a basement or a bathroom of a home.

A problem with current grinder pump systems is that, when the grinder pump is in operation grinding up solid or semisolid materials, a significant amount of vibration and torquing occurs, which impacts the longevity of the grinder pump and its components. Further, because of the types of solid materials present in the waste water, clogging of these pumps systems has also become a problem.

Some grinder pumps are large pumps designed to receive significant quantities of solid waste from a multi-unit structure. However, because such grinder pumps are large, they are difficult to use in locations where space is limited, such as a basement bathroom.

In addition, some current grinder pumps are sometimes not efficient in grinding up solids that are present in the waste water or the solids clog the grinder pump, particularly if they are smaller, fractional horsepower grinder pumps.

Accordingly, it is one object of the invention to provide an improved grinder pump with an improved cutting system for the grinder pump which addresses and overcomes these difficulties.

A further object of the invention is to provide an improved grinder pump which utilizes a fractional horsepower motor but which is able to cut solids efficiently because of a unique design of a cutting system used with said grinder pump.

A further object of the invention is to provide an improved grinder pump for use in small spaces, such as a bathroom, particularly behind a toilet.

Other objects are addressed by the disclosures and claims contained herein.

SUMMARY OF THE INVENTION

The present invention relates to a novel, reversible grinder pump which receives waste water containing solids. A lower portion of the reversible grinder pump includes a unique cutter plate and cutter blade which interact with waste water containing solids that enter the grinder pump to efficiently cut up the solids in the waste water into small pieces for removal.

In a preferred embodiment, the lower portion of the grinder pump includes a cutter plate with uniquely shaped openings therein which act in coordination with a uniquely shaped cutter blade to efficiently cut up solids present in the waste water that enter the openings in the cutter plate while the reversible grinder pump is operating.

In a further preferred embodiment, the uniquely shaped openings of the cutter plate include pairs of angled openings, wherein each angled opening of the pair extends through the cutter plate, wherein each angled opening of the pair includes multiple sides including a straight cutting edge and an adjacent concave shaped cutting edge, wherein ends of the straight cutting edge and the concave shaped cutting edge where they meet form a substantially V-shaped angled cutting feature, and wherein each of the pair of angled openings has a shape which is a mirror image of the other angled opening of the pair, when viewed from above a surface of the cutter plate.

In a further preferred embodiment, there is utilized with the uniquely shaped cutter plate a uniquely shaped cutter blade, which includes a pair of triangular cross section, prism-shaped cutting edges, which triangular shapes are congruent to each other and also reflective of each other, extending in opposite directions from each other. As a result of the unique design of the cutting edges of the cutter blade when used in coordination with the mirror image pairs of angled openings of the cutter plate, solids are efficiently cut, regardless of which direction the reversible grinder pump is rotating.

In a further preferred embodiment, there is utilized the uniquely shaped cutter plate and uniquely shaped cutter blade forming an important portion of a reversible, fractional horsepower grinder system, which can be placed in small locations, such as a bathroom, and is small enough to be located behind a toilet.

These and other embodiments are achieved by the products disclosed in the drawings, the detailed description and the products, as disclosed herein.

While the present disclosure describes various embodiments of the various inventions, it is not limited by the disclosures contained within the drawings or specification. The drawings describe at least one presently preferred embodiment and should be considered an exemplification thereof. They are not intended to limit the invention to any specific embodiment or embodiments described therein.

DETAILED DESCRIPTION

Figure 1:
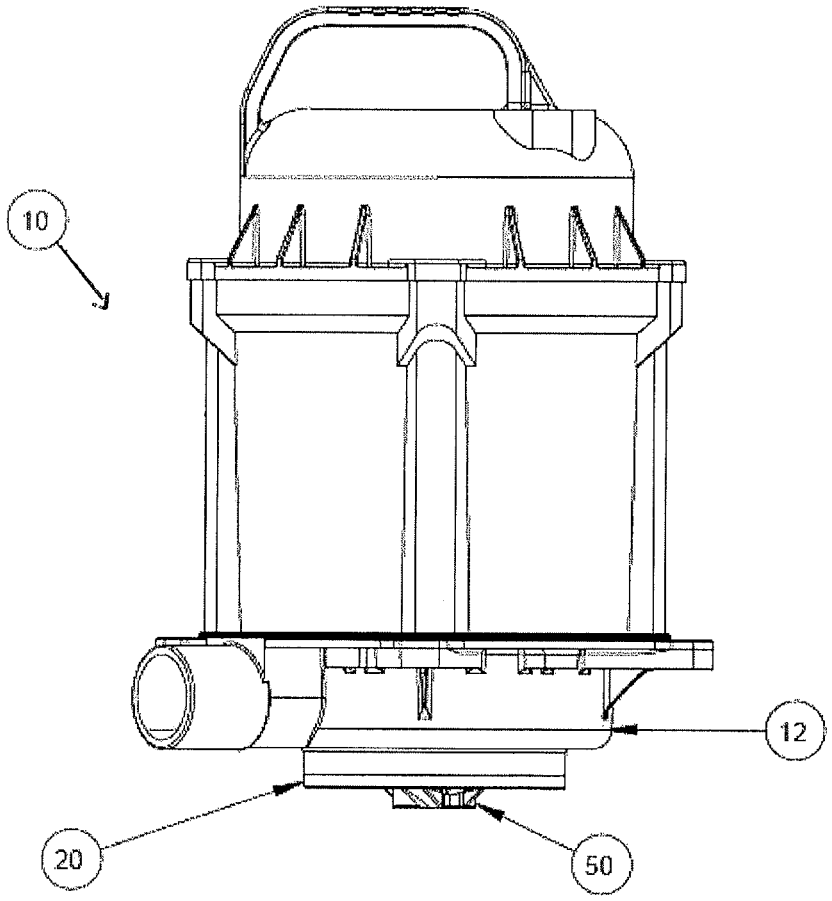
FIG. 1 is a side view of a fractional horsepower, reversible grinder pump with cutter plate.
Figure 2:
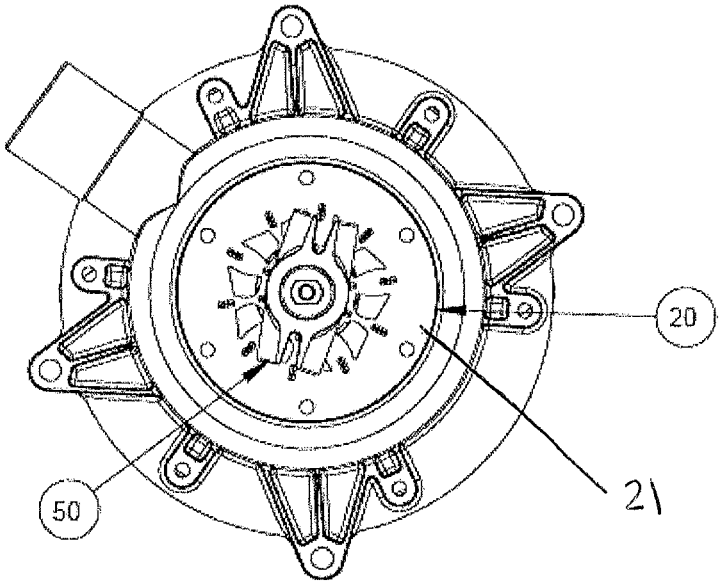
FIG. 2 is a bottom view of the reversible grinder pump of FIG. 1.

FIGS. 1 and 2 disclose a reversible grinder pump (10). The reversible grinder pump has the capability for operating with either a clockwise or a counter-clockwise rotation of the cutting system for cutting solids that enter the grinder pump. Although the grinder pump can be utilized with large horsepower pumps, in one preferred embodiment, the reversible grinder pump utilizes a fractional horsepower, reversible grinder pump.

A bottom portion of the reversible grinder pump (12), includes a cutter plate (20) and cutter blade (50), as shown in FIG. 2. In one usage the reversible grinder pump may be secured within a basin system, such as disclosed, for example, in U.S. Pat. No. 9,352,327, the contents of which are incorporated herein by reference, and which basin system is sold by Zoeller Pump Company, LLC as the Model 800 grinder pump used with the 915 basin system.

Figure 3:
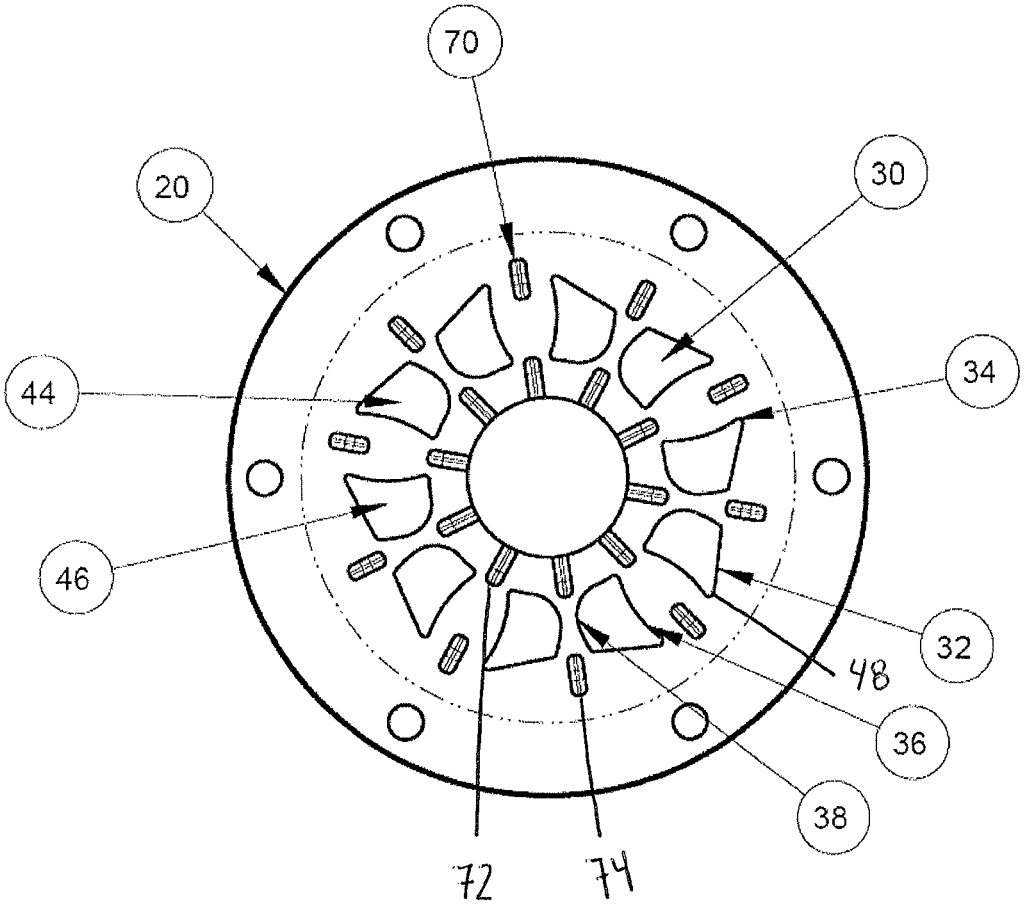
FIG. 3 is a top view of a cutter plate used with the reversible grinder pump of FIG. 1.
Figure 3A:
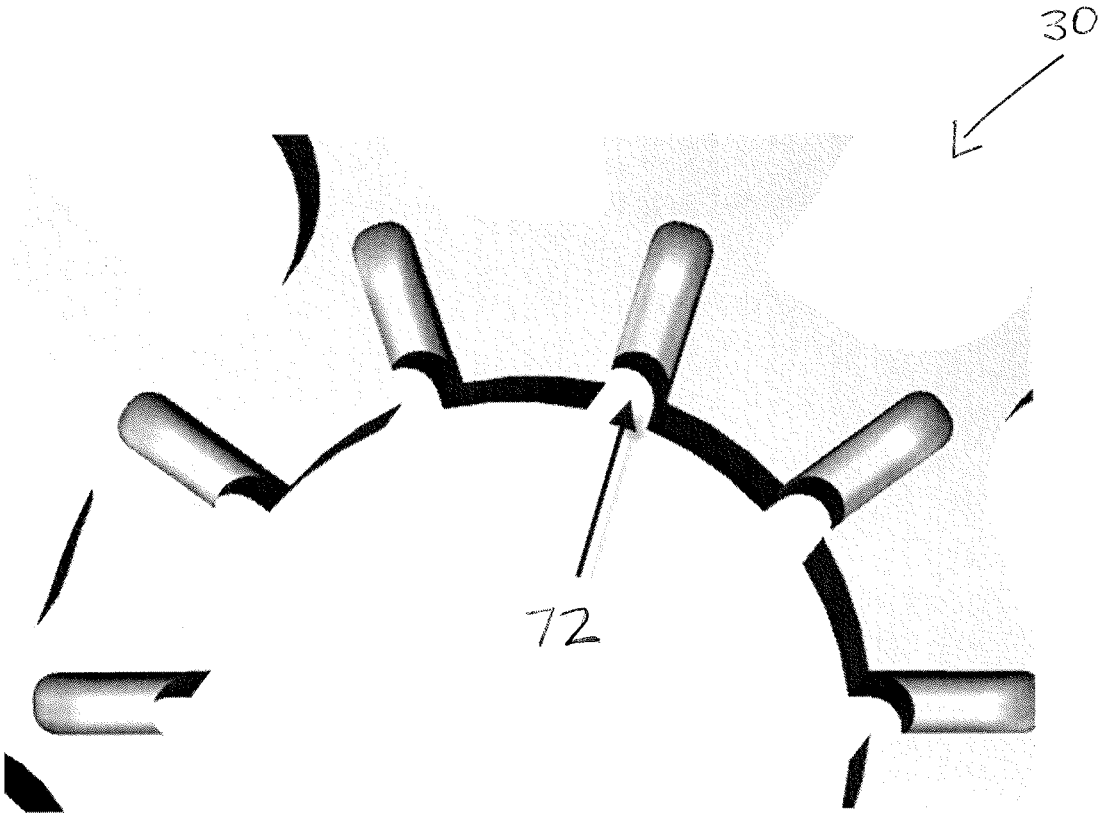
FIG. 3A is a cutaway, partial top view of the cutter plate of FIG. 3.
Figure 4:
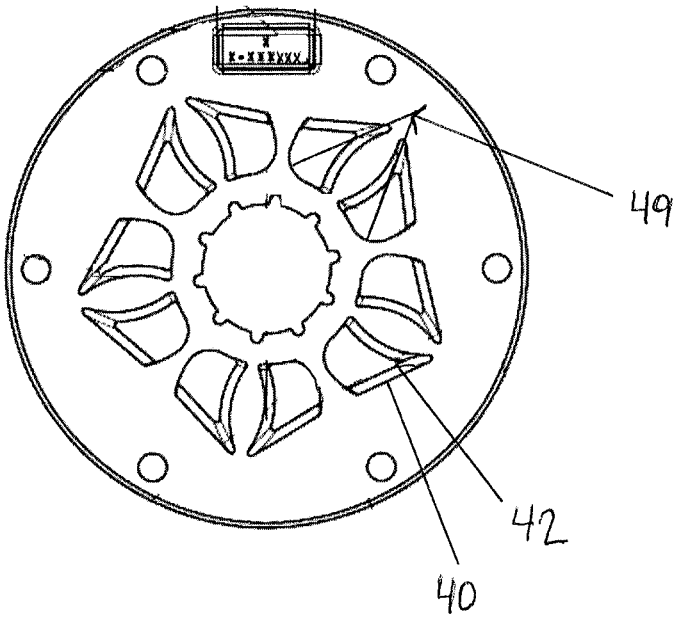
FIG. 4 is a bottom view of the cutter plate of FIG. 2.

The cutter plate (20) used with the grinder pump of FIGS. 1 and 2, as shown in FIGS. 3, 3A and 4, includes a series of pairs (44, 46) of angled openings (30) extending therethrough. Fluid and solid material entering the pump inlet pass through these angled openings. By the interaction of a cutter blade (50) and the angled openings in the cutter plate, solids are ground into small enough size to be disposed through the discharge system of the grinder pump.

The cutter blade (50), as shown in FIGS. 5, 6, 7 and 8, of the reversible grinder pump (10) of FIGS. 1 and 2, is secured adjacent to the cutter plate (20), as shown in FIG. 2. The cutter blade is designed to rotate clockwise or counter clockwise in relation to the cutter plate to efficiently cut solids into small pieces as they pass through the pairs of angled openings (30) in the cutter plate by the interaction of the cutter blade with the pairs of angled openings in the cutter plate. Because the disclosed grinder pump is reversible, it is necessary that the cutter blade operates efficiently in coordination with the cutter plate, regardless of which direction the cutter blade rotates.

In certain embodiments the cutter blade (50) is secured directly in contact with the cutter plate (20). Alternatively, the cutter blade may be secured to the grinder pump not in direct contact with the cutter plate and thus is separated by a small distance from the surface (21) of the cutter plate, although the cutter plate and the cutter blade are still located substantially parallel and adjacent to each other. The particular arrangement of the cutter plate and the cutter blade is dependent upon the goal and operation of the reversible grinder pump. Arrangements for the respective location of these components are discussed in more detail in U.S. Pat. No. 8,562,287, which is incorporated by reference herein.

The pairs of angled openings (44, 46) in the cutter plate (20), as shown in FIGS. 3, 3A and 4, are preferably formed with a particular shape to assist in the cutting of solids as they enter the reversible grinder pump. It has been surprisingly discovered that the size, location and shape of these angled openings is important for the efficient operation of the reversible grinder pump. The overall shape of the angled openings in the reversible grinder pump is similar to the shape disclosed for the angled openings in U.S. Pat. No. 9,352,327, which is incorporated herein by reference.

It has been surprisingly discovered, however, that the particular shape and relationship between each angled opening in the cutter plate must be carefully coordinated for efficient operation, especially of a fractional horsepower, reversible grinder pump. It has been surprisingly discovered that, instead of each angled opening having the same shape, as shown in U.S. Pat. No. 9,352,327, pairs of similarly shaped, but reflectively oriented, mirror image openings in the cutter plate are more efficient for the cutting of solids by the reversible grinder pump disclosed herein. Preferably, there are several pairs of angled openings, preferably at least about four (4) pairs of angled openings in each cutter plate, although the total number of pairs depends on the size of the cutter plate and grinder pump.

The shape of the angled openings (30) in the reversible grinder pump includes a straight cutting edge first side (32), which meets with, and forms a substantially V-shape angled cutting edge (34), with a slightly concave cutting edge second side (36) of the angled openings. The angle of this substantially V-shaped cutting angle is from about 15 degrees to about 80 degrees, preferably from about 30 degrees to about 65 degrees.

The second ends of these two cutting edges (32, 36) are joined by a generally convex cutting edge third side (38), as shown in FIGS. 3, 3A and 4. These three cutting edge sides form a preferred embodiment of each angled openings (30) of the cutter plate (20), as long as the angled openings are formed as pairs of reflectively oriented, angled openings, as discussed herein.

The inside surfaces (40, 42) of the straight cutting edge first side (32) and the slightly concave cutting edge second side (36), as shown in FIG. 4, extend through the body of the cutter plate to form a sharp cutting surface which assists in cutting solid materials that enter these angled openings. The angle of the inside surfaces of the straight cutting edge and the slightly concave cutting edge is between about 90 degrees and 150 degrees, preferably 90 degrees to about 120 degrees.

It has been surprisingly discovered that the use of only one orientation of the shaped angled openings in the cutter plate is not sufficient when used with a reversible grinder pump (10). Rather, it has been surprisingly discovered that the angled openings in the cutter plate (30) should be utilized in pairs of angled openings (44,46), wherein each of the pair of angled openings has a shape which is a mirror image of the other angled opening of the pair, when viewed from above a surface of the cutter plate, as shown in FIGS. 3, 3A and 4.

It has been surprisingly discovered that angled openings that have the same shape and orientation operate efficiently when the cutter blade rotates in one direction. However, when the grinder pump is reversed, the cutter blade operates effectively only when used when the orientation of the angled openings is reversed.

In one embodiment, as shown in FIG. 4, an angle (49) formed by lines bisecting respective substantially V-shaped cutting angles of a pair of angled openings, formed by the respective straight cutting edge first side (32) and the slightly concave cutting edge second side (36) of each of the pair of angled openings of the pair of angled openings, is between about 45 degrees and 90 degrees.

The shape of the cutter blade (50) also assists in the efficient operation of the reversible grinder pump, particularly a fractional horsepower, reversible grinder pump. As shown in FIGS. 5-8, the cutter blade contains a pair of triangular, cross section, prism-shaped cutting edges (52, 54), which respective triangular shapes are congruent to each other but reflective of each other, thus extending in opposite directions from each other, as shown in FIG. 7. The angle (58) of the cutting edges (52,54) of the cutter blade (50) is an acute angle ranging from about 20 degrees to about 90 degrees, preferably from about 45 degrees to about 75 degrees. The triangular cross section, prism-shaped cutting edges do not extend entirely across the width of the cutting blade but they are of sufficient width to form cutting edges that efficiently cut solid materials that are contacted by those cutting blades as they cross the cutting plate (20).

Figure 5:
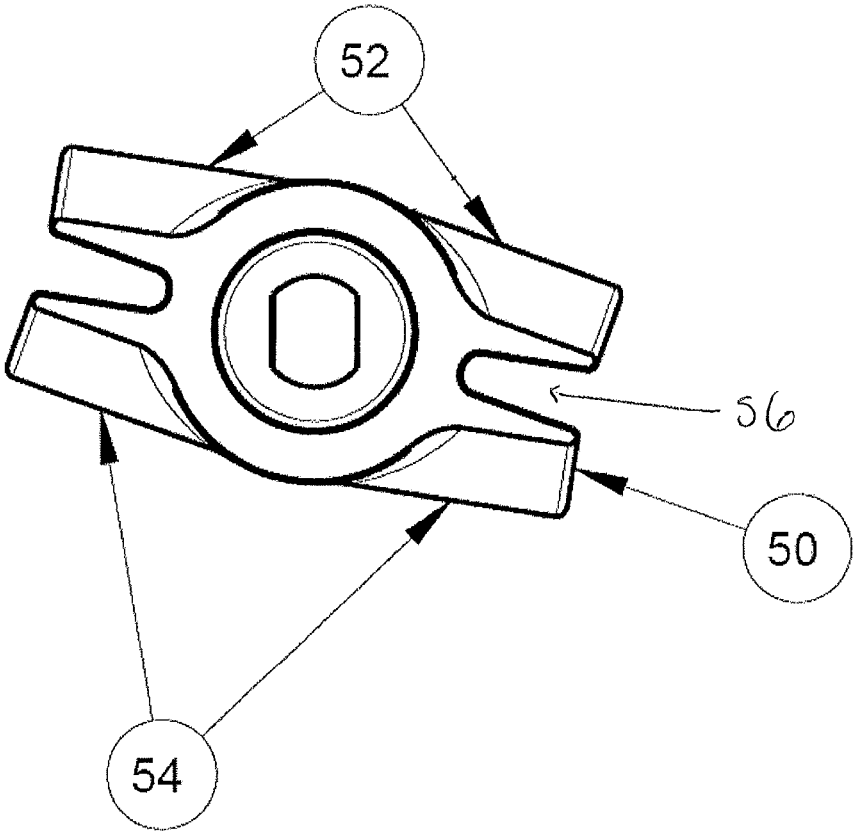
FIG. 5 is a top view of a cutter blade used with the reversible grinder pump of FIG. 1.
Figure 6:
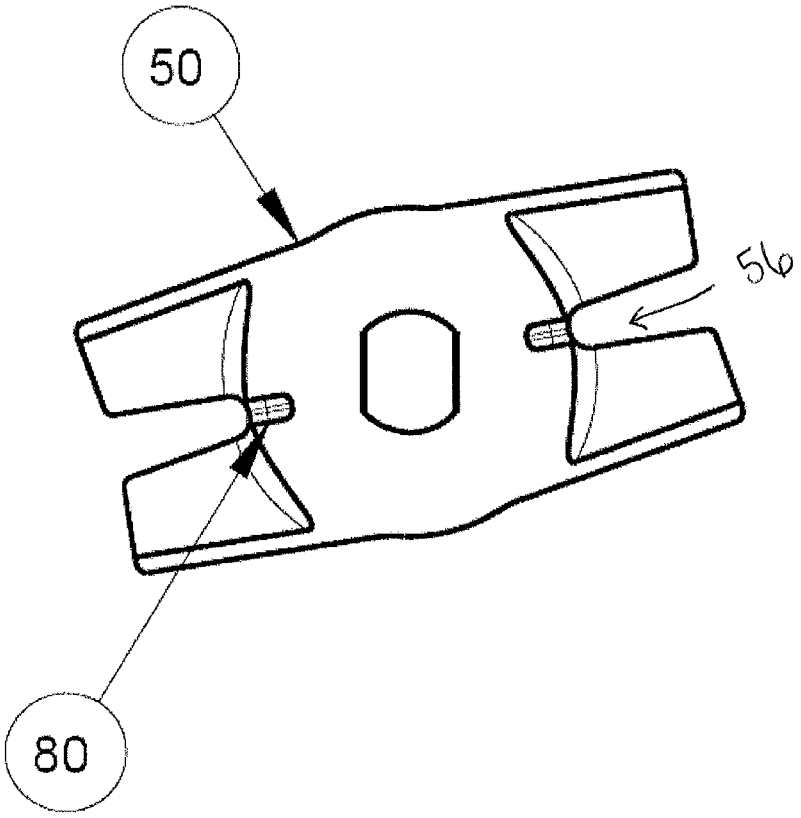
FIG. 6 is a bottom view of the cutter blade of FIG. 5.
Figure 7:
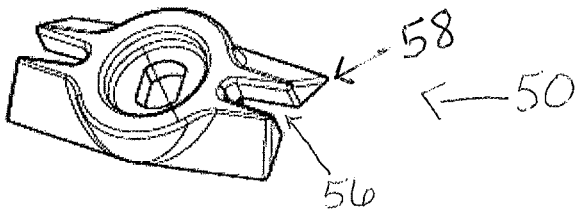
FIG. 7 is a perspective view of the cutter blade of FIG. 5.
Figure 8:
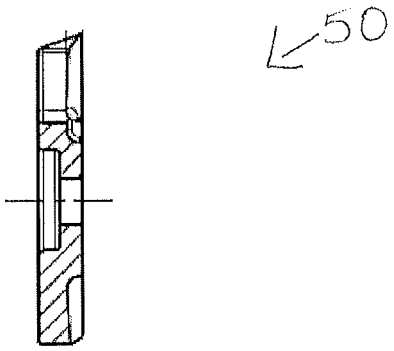
FIG. 8 is a side cutaway view of the cutter blade of FIG. 5.

As shown in FIGS. 5-7, there is also an inset gap (56) cut into the ends of the cutter blade (50) between the cutting edges. The sides of this inset gap are formed by the respective cutting edges (52, 54). These inset gaps allow material that is cut, but not forced through the cutter plate, to be ejected from the cutter blade. This shape prevents jamming of the grinder pump due to excessive material around the cutter blade. The angle of this inset gap is preferably from about 5 degrees to about 30 degrees.

There are also preferably relief cuts (80) at the end of each inset gap (56) which assists in the cutting of solid materials, as shown in FIG. 6.

In addition to the shape of the pair of angled openings (44,46) in the cutter plate (20), the position of the cutting edges (52,54) of the cutter blade (20) in relation to the cutting edges of the angled openings in the cutter plate as they cross said angled openings in operation also assists in the efficient cutting of solids that enter the angled openings. Because of the choice of the V-shaped cutting angles of the angled openings in the cutter plate, as shown in FIGS. 3, 3A and 4, the cutting edges of the cutter blade cross the angled openings to force solids between the straight cutting edge (32) and the concave cutting edge (36) and force solids to the meeting point of these edges and thereby efficiently cutting the solids, forcing them through the angled openings. In this preferred embodiment the angles of the cutting edges of the cutter blade interact with the V-shape angled cutting edge of the angled openings in the cutter plate to efficiently cut solid materials as they enter the reversible grinder pump.

Because the angled openings (30) in the cutter plate (20) are formed in pairs (44,46), wherein each of the pairs of the angled openings has a shape which is a mirror image of the other angled opening of the pair, when viewed from above the surface of the cutter plate, the cutter blade, which has a pair of triangular cross section, prism-shaped cutting edges (52,54), which are congruent to each other but reflective thus extending in opposite directions from each other, solid material is forced between the straight cutting edge first side (32) and the concave cutting edge second side (36) of the cutting blade (20) regardless of the direction of rotation of the cutter blade (50) in relation to the cutter plate. The unique design of both the cutter plate and the cutter blade allow for the efficient and effective cutting of solids by the fractional horsepower reversible grinder pump (10).

It has been surprisingly discovered that by use of these pairs of uniquely shaped angled openings in the cutter plate, in coordination with the unique shape of the cutting blade, solid material passing through the reversible grinder pump is cut more efficiently than has been done in the past. These shapes increase the cutting ability, reduce motor torque, and the cutting force required to grind up solids as they enter the pump inlet.

In some grinder pumps, such as disclosed in U.S. Pat. No. 8,562,287, there have been secured to the bottom portion of the grinder pump a ring which is secured to the outside edge of the cutter plate beyond the angled openings therein. This ring has been necessary in some grinder pumps to channel fluid and materials into the angled openings in the cutter plate. However, with the preferred design of the angled openings in the cutter plate, and the preferred design of the cutter blade, along with other innovations disclosed herein, it has been surprisingly discovered that this ring is not necessary.

This ring is also not necessary because of the presence of relief cuts (70) in the outer surface of the cutter plate (20) and relief cuts (80) in the inner surface of the cutter blade (50), as shown in FIGS. 3, 3A and 6. These relief cuts can be of any shape, length or depth as is useful, but are generally about the same length as the straight cutting edge first side (32) of the cutter plate and comprise a rounded trough-like cut, as shown in FIGS. 3 and 6.

Further, preferably, there are two groups of relief cuts in the outer surface of the cutter plate, one set (72) extending from the center opening in the cutter plate outward and a second set (74) located further out from the opening, as shown in FIG. 3. In a preferred embodiment, a portion (70) of the relief cuts present in the group of relief cuts extending outward from the center opening in the cutter plate extends entirely through the cutter plate, as shown in FIG. 3A.

The relief cuts in the surface of the cutter blade, as shown in FIG. 5 are approximately the same shape as the relief cuts in the cutter plate.

During operation of the grinder pump, these relief cuts assist in the cutting of solids and prevent the space between the cutter blade and the cutter plate from becoming clogged with solid materials. Along with the other features of the reversible, grinder pump, these relief cuts assist in the channeling of fluids and solid materials into the pump inlet and reduce the opportunity for solids to catch and become trapped underneath the cutter blade or wrap around the shaft of the grinder pump, thereby eliminating the need for a ring to be secured to the bottom surface of the grinder pump.

It will also be understood by those skilled in the art that this grinder pump with cutter plate and cutter blade can be used for other systems than the disclosed system, such as in a pump basin under a sink for grinding up food and other materials or as a waste pumping system, such as disclosed in U.S. Pat. No. 9,352,327.

It should be understood that the foregoing description is only illustrative of the various disclosed inventions. Various alternatives and modifications can be devised by those skilled in the art without departing from the scope of the invention. The present invention is intended to embrace alternatives, modifications, and variances which fall within the scope of the attached claims.

LISTING OF COMPONENTS reversible grinder pump (10)
bottom portion of the reversible grinder pump (12)
cutter plate (20)
surface of cutter plate (21)
angled openings (30)
straight cutting edge first side (32)
V-shaped cutting angle (34)
concave cutting edge second side (36)

convex cutting edge third side (38)
inside surfaces (40, 42)
pairs of angled openings (44,46)
angle (48)
angle formed by lines bisecting respective substantially V-shaped cutting angles (49)
cutter blade (50)
pair of triangular, cross section, prism-shaped cutting edges (52,54)
inset in cutter blade angle (56)
angle of cutting edges (58)
relief cuts in the surface of the cutter plate (70)
relief cuts in the outer surface of the cutter plate, extending from the center opening in the cutter plate outward (72)
relief cuts in the outer surface of the cutter plate, located further out from the opening (74)
relief cuts in the surface of the cutter blade (80)

The invention claimed is:

1. A reversible grinder pump comprising
a reversible cutter plate and a cutter blade, each attached to a body of the reversible grinder pump,
wherein the cutter blade is located adjacent to the cutter plate;
wherein the cutter plate comprises pairs of separate, angled openings, wherein each angled opening extends through a body of the cutter plate;
wherein each separate, angled opening comprises a straight cutting edge first side and an adjacent concave shaped cutting edge second side,
wherein first ends of the straight cutting section first side and the concave shaped cutting edge second side of the separate, angled opening form a substantially V-shaped cutting angle, and
wherein each of the separate, angled openings of each pair of angled openings has a shape which is a mirror image of the other separate, angled opening of the pair, when viewed from above a surface of the cutter plate.

2. The reversible grinder pump of claim 1 further comprising relief cuts in the surface of the cutter plate.

3. The reversible grinder pump of claim 1 wherein the separate angled opening further comprises a convex shaped third side which joins a second end of the first side with a second end of the second side.

4. The reversible grinder pump of claim 1 wherein no ring is secured to an outside edge of the cutter plate to secure the cutter plate to the grinder pump.

5. The reversible grinder pump of claim 1 wherein a motor for the reversible grinder pump is a fractional horsepower motor.

6. The reversible grinder pump of claim 2 wherein a portion of the relief cuts in the cutter plate extends entirely through the cutter plate.

7. The reversible grinder pump of claim 2 wherein the relief cuts have a rounded that extends further in one direction then another.

8. A reversible grinder pump comprising
a reversible cutter plate and a cutter blade, each attached to a body of the reversible grinder pump,
wherein the cutter blade is located adjacent to the cutter plate;
wherein the cutter plate comprises pairs of separate, angled openings, wherein each angled opening extends through a body of the cutter plate;
wherein each separate, angled opening comprises a straight cutting edge first side and an adjacent concave shaped cutting edge second side,
wherein first ends of the straight cutting section first side and the concave shaped cutting edge second side of the separate, angled opening form a substantially V-shaped cutting angle,
wherein each of the separate, angled openings of each pair of angled opening has a shape which is a mirror image of the other separate, angled opening of the pair, when viewed from above a surface of the cutter plate, and
wherein the cutter blade comprises a pair of triangular cross section, prism-shaped cutting edges, which cross sections are congruent to each other and also reflective, thus extending in opposite directions from each other.

9. The reversible grinder pump of claim 8 wherein the cutter blade further comprises slots in the cutter blade substantially parallel to the pair of triangular cross section prism-shaped cutting edges.

10. The reversible grinder pump of claim 8 wherein, during operation of the reversible grinder pump, one of the pairs of triangular cross section prism-shaped cutting edges cross one of the pair of separate, angled openings such that solid material entering said angled opening is forced between the straight cutting edge first side and the concave shaped cutting edge second side.

11. The reversible grinder pump of claim 8 wherein the cutter blade further comprises relief cuts in a surface of the cutter blade.

12. The reversible grinder pump of claim 8 wherein no ring is secured to an outside edge of the cutter plate to secure the cutter plate to the grinder pump.

13. The reversible grinder pump of claim 8 wherein a motor for the reversible grinder pump is a fractional horsepower motor.

14. The reversible grinder pump of claim 8 wherein the cutter plate further comprises relief cuts in a surface of the cutter plate.

15. The reversible grinder pump of claim 14 wherein said relief cuts are at least as long as a length of the straight cutting edge of the opening in the cutter plate.

16. The reversible grinder pump of claim 14 wherein the relief cuts have a rounded shape that extends further in one direction than another.

17. The reversible grinder pump of claim 8 wherein both the cutter plate and the cutter blade further comprise relief cuts in a surface of the cutter blade and the cutter plate, each relief cut having a rounded shape that extends further in one direction than another.

* * * * *